US006955634B1

(12) United States Patent
Lat

(10) Patent No.: US 6,955,634 B1
(45) Date of Patent: Oct. 18, 2005

(54) SKIING EXERCISE DEVICE

(76) Inventor: Shu-Chtung Lat, No. 57-15, An-Lin Rd., Hsi-Tun Dist., Taichung City (TW)

( * ) Notice: Subject to any disclaimer, the term of this patent is extended or adjusted under 35 U.S.C. 154(b) by 15 days.

(21) Appl. No.: 10/810,054

(22) Filed: Mar. 26, 2004

(51) Int. Cl.[7] ..... A63B 69/18
(52) U.S. Cl. ..... 482/71; 434/253
(58) Field of Search ..... 482/51, 52–53, 482/57, 70–71, 79–80; 434/253

(56) References Cited

U.S. PATENT DOCUMENTS

| | | | | |
|---|---|---|---|---|
| 5,391,130 A * | 2/1995 | Green et al. | ..... | 482/71 |
| 5,628,709 A * | 5/1997 | Chen | ..... | 482/53 |
| 5,665,033 A * | 9/1997 | Palmer | ..... | 482/71 |
| 5,692,995 A * | 12/1997 | Alvarez et al. | ..... | 482/71 |
| 6,135,930 A * | 10/2000 | Kuo | ..... | 482/72 |
| 6,494,813 B2 * | 12/2002 | Chen | ..... | 482/53 |

* cited by examiner

*Primary Examiner*—Stephen R. Crow
(74) *Attorney, Agent, or Firm*—Christie, Parker and Hale, LLP

(57) ABSTRACT

A skiing exercise device includes a base frame having a front end portion with a pair of pivot poles disposed on opposite sides of a vertical plane. Each pivot pole has a pole axis inclining at an angle relative to the vertical plane. Each of two stepper members includes a foot support mounted on a supporting rod that extends from a pivot tube, which is sleeved rotatably on a respective pivot pole, in a longitudinal direction parallel to the vertical plane toward a rear end portion of the base frame, and a coupling flange extending from the pivot tube away from the vertical plane. A coupling unit includes a reel-mounting seat mounted on and movable in the longitudinal direction relative to the front end portion of the base frame, a reel mounted rotatably on the reel-mounting seat and disposed between the stepper members, and a cord wound on the reel and having opposite ends connected respectively to the coupling flanges of the stepper members.

4 Claims, 12 Drawing Sheets

SKIING EXERCISE DEVICE

BACKGROUND OF THE INVENTION

1. Field of the Invention

The invention relates to an exercise device, more particularly to a skiing exercise device.

2. Description of the Related Art

Referring to FIG. 1, a conventional stepper exercise device 10 is shown to include a base member 11 having a front end portion 12, a pair of foot supports 14 connected pivotally to the front end portion 12, and a pair of hydraulic resistance cylinders 15, each of which is pivoted to the front end portion 12 and a respective one of the foot supports 14. Although the above-mentioned conventional stepper exercise device 10 can achieve its intended purpose, the operation of the conventional stepper exercise device 10 is monotonous such that the functionality and effect thereof are limited.

Referring to FIG. 2, a conventional skiing exercise device 20 is shown to include a bottom frame 21, a Y-shaped support member 22 disposed uprightly on a rear end of the bottom frame 21, a pair of pivot rods 23 pivoted to the Y-shaped support member 22, a pair of foot supports 24 mounted respectively on the pivot rods 23, and a pair of handle rods 25, each of which has a lower end pivoted to the bottom frame 21. Each of a set of first hydraulic resistance cylinders 26 is pivoted to the bottom frame 21 and a respective one of the handle rods 25. Each of a set of second hydraulic resistance cylinders 27 is pivoted to the support member 22 and a respective one of the pivot rods 23. As such, skiing exercise can be achieved through operation of the handle rods 25 as well as the foot supports 24. However, due to the use of several hydraulic resistance cylinders 26, 27, the conventional skiing exercise device 20 is relatively expensive. Furthermore, since each foot support 24 is operated independently, smooth stepper exercise cannot be ensured in view of uneven pressing forces on the foot supports 24.

SUMMARY OF THE INVENTION

Therefore, the object of the present invention is to provide a skiing exercise device that has a simple construction.

According to the present invention, a skiing exercise device comprises:

- a base frame having front and rear end portions opposite to each other in a longitudinal direction, the front end portion having a pair of pivot poles disposed on opposite sides of a vertical plane that is parallel to the longitudinal direction, each of the pivot poles having a pole axis that inclines at an angle relative to the vertical plane;
- a pair of stepper members, each of which includes a pivot tube sleeved rotatably on a respective one of the pivot poles, a supporting rod extending from the pivot tube in the longitudinal direction toward the rear end portion of the base frame, a foot support mounted on the supporting rod, and a coupling flange extending from the pivot tube away from the vertical plane; and
- a coupling unit including a reel-mounting seat mounted on and movable in the longitudinal direction relative to the front end portion of the base frame, a reel mounted rotatably on the reel-mounting seat and disposed between the stepper members, and a cord wound on the reel and having opposite ends that are connected respectively to the coupling flanges of the stepper members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
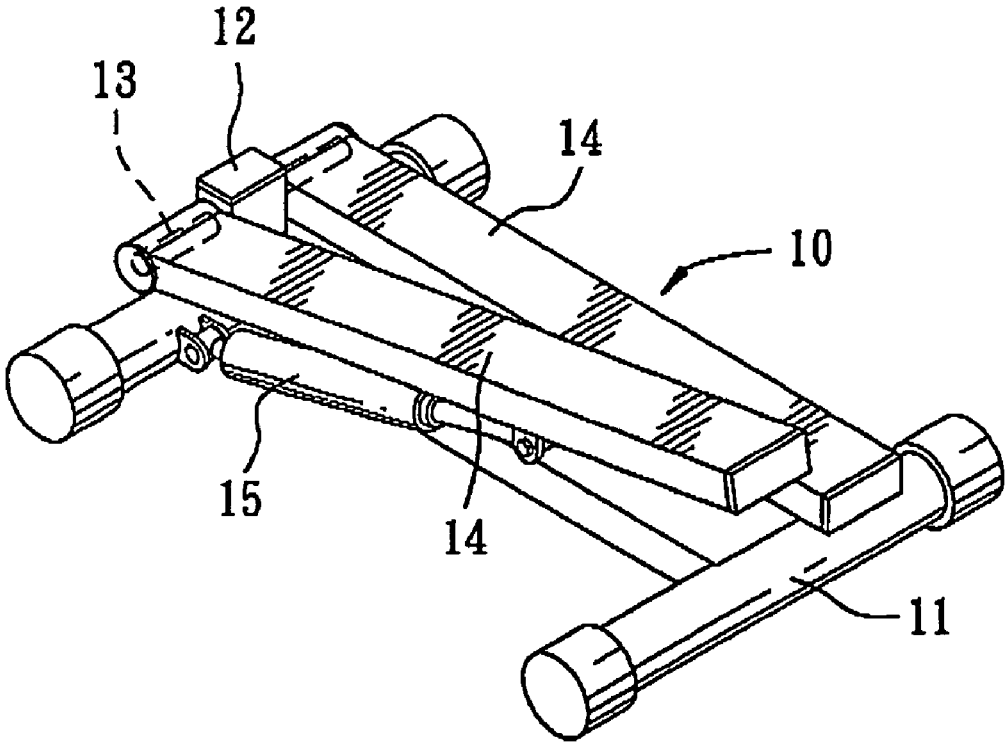
FIG. 1 PRIOR ART
FIG. 1 is a perspective view of a conventional stepper exercise device.
Figure 2:
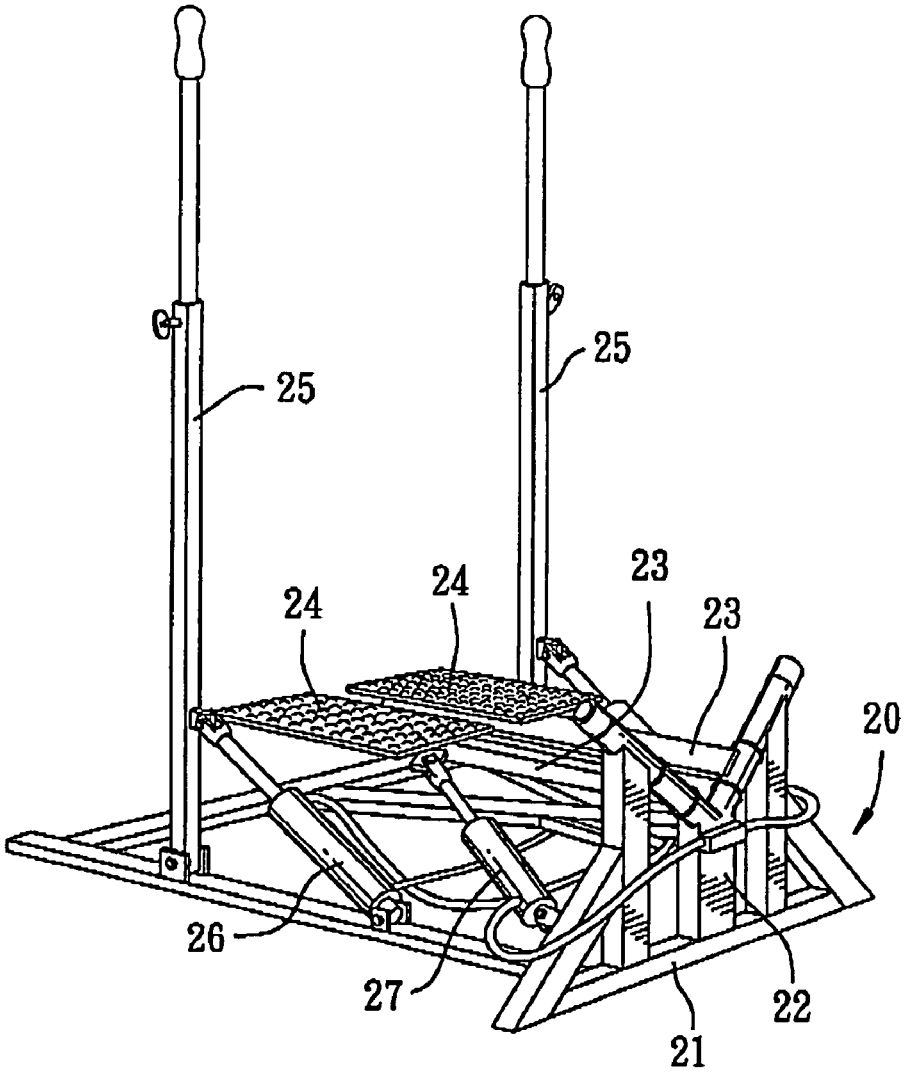
FIG. 2 PRIOR ART
FIG. 2 is a perspective view of a conventional skiing exercise device.
Figure 3:
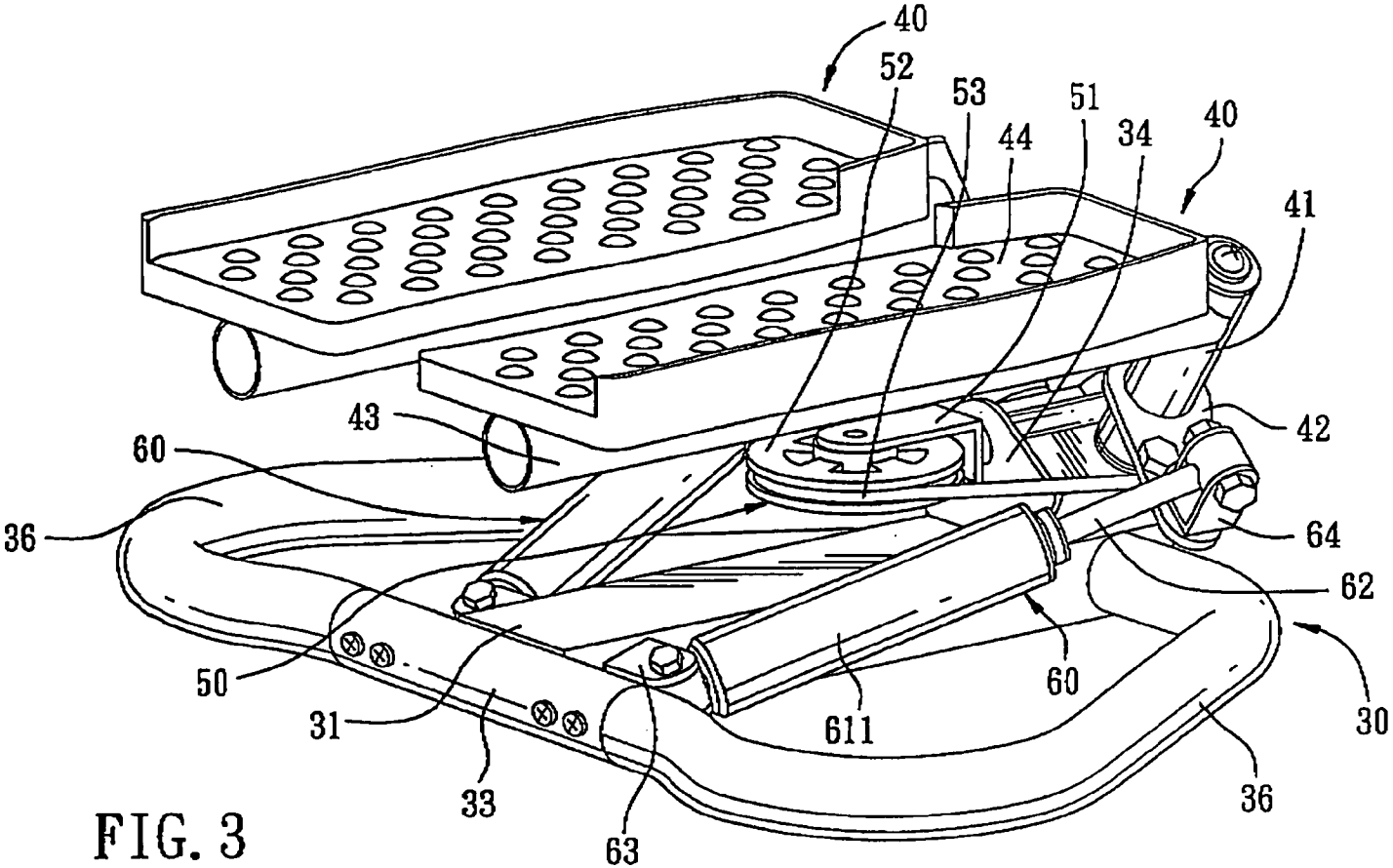
FIG. 3 is a perspective view showing the preferred embodiment of a skiing exercise device according to this invention.
Figure 4:
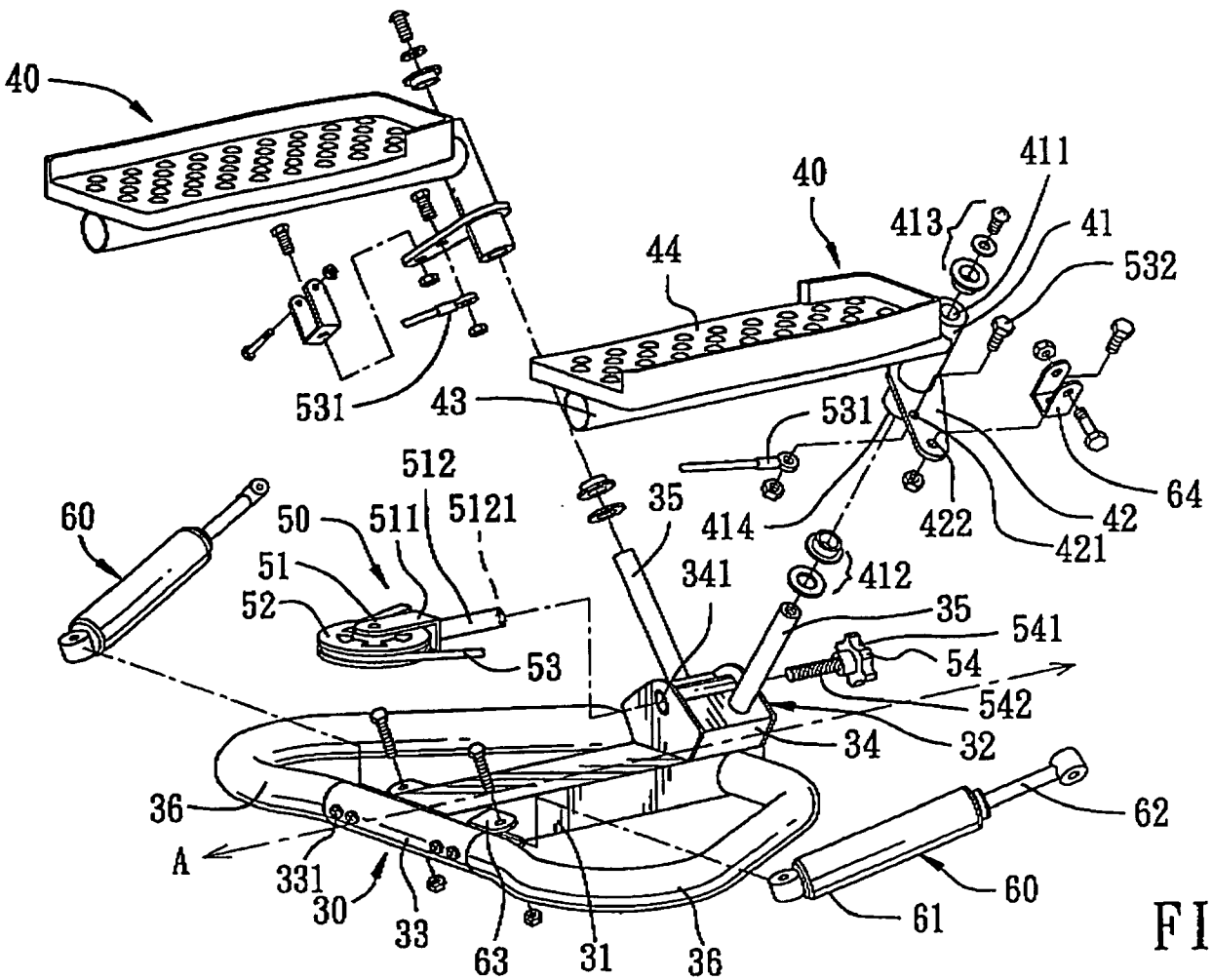
FIG. 4 is an exploded perspective view showing the preferred embodiment.

Referring to FIGS. 3 and 4, the preferred embodiment of a skiing exercise device according to the present invention is shown to include a base frame 30, a pair of stepper members 40, a coupling unit 50, and a pair of damping members 60.

Figure 5:
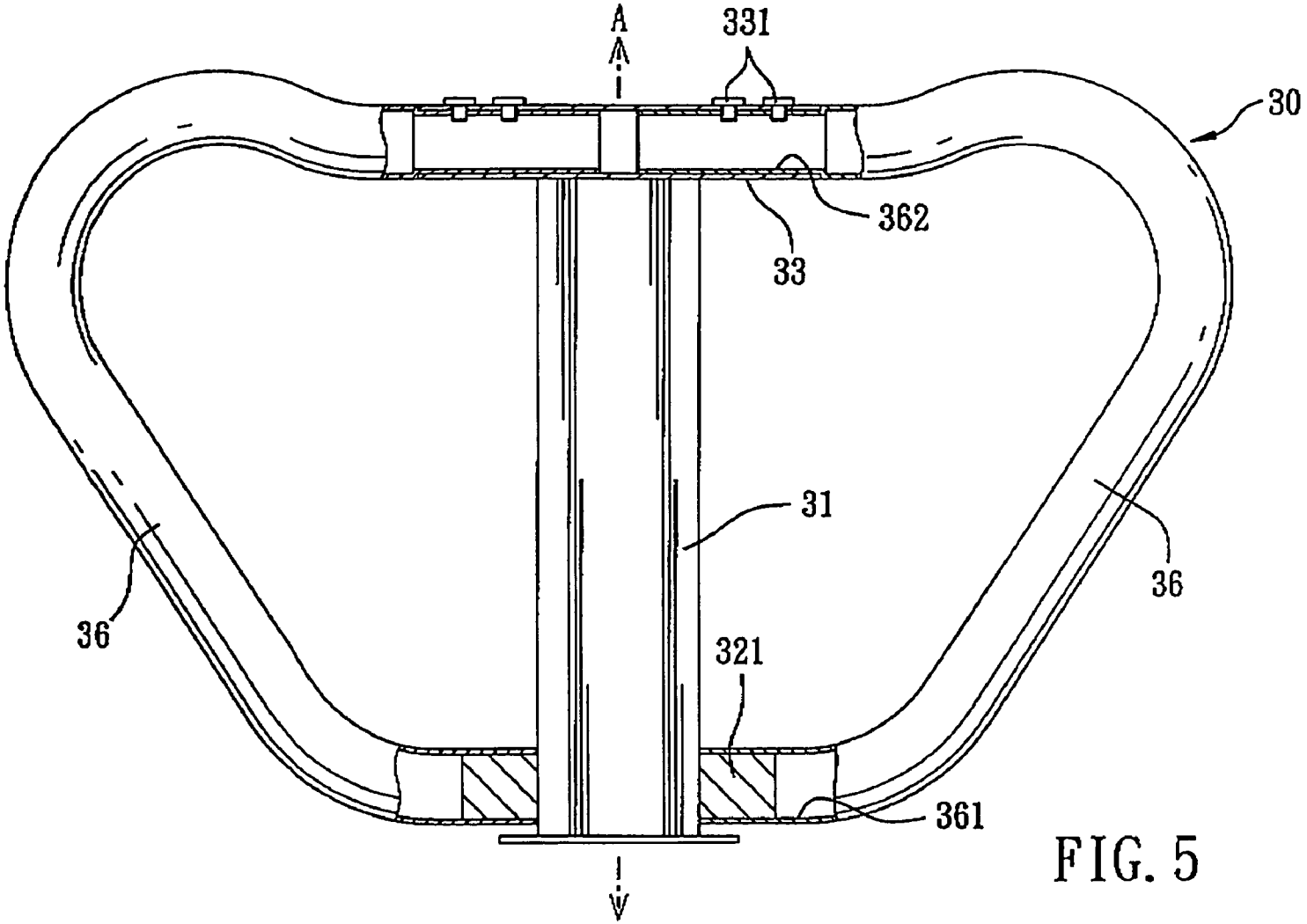
FIG. 5 is a partly sectional schematic view showing a base frame of the preferred embodiment.

In this embodiment, the base frame 30 has front and rear end portions 32, 33 opposite to each other in a longitudinal direction (A), an intermediate portion 31 interconnecting the front and rear end portions 32, 33, and opposite lateral tubes 36 coupled respectively to and extending between the front and rear end portions 32, 33. The front end portion 32 includes a rod body 321, a pole-mounting seat 34 mounted on the rod body 321, and a pair of pivot poles 35 mounted on the pole-mounting seat 34 and disposed on opposite sides of a vertical plane (B) (see FIG. 7) that is parallel to the longitudinal direction (A). Each of the pivot poles 35 has a pole axis (X1, X2) (see FIG. 7) that inclines at an angle (θ) relative to the vertical plane (B) (see FIG. 7). Each of the lateral tubes 36 has a first end portion 361 inserted with a respective end of the rod body 321 therein, and a second end portion 362 inserted into a respective tubular end of the rear end portion 33 and fastened there to by a pair of fasteners 331, as best shown in FIG. 5.

Figure 6:
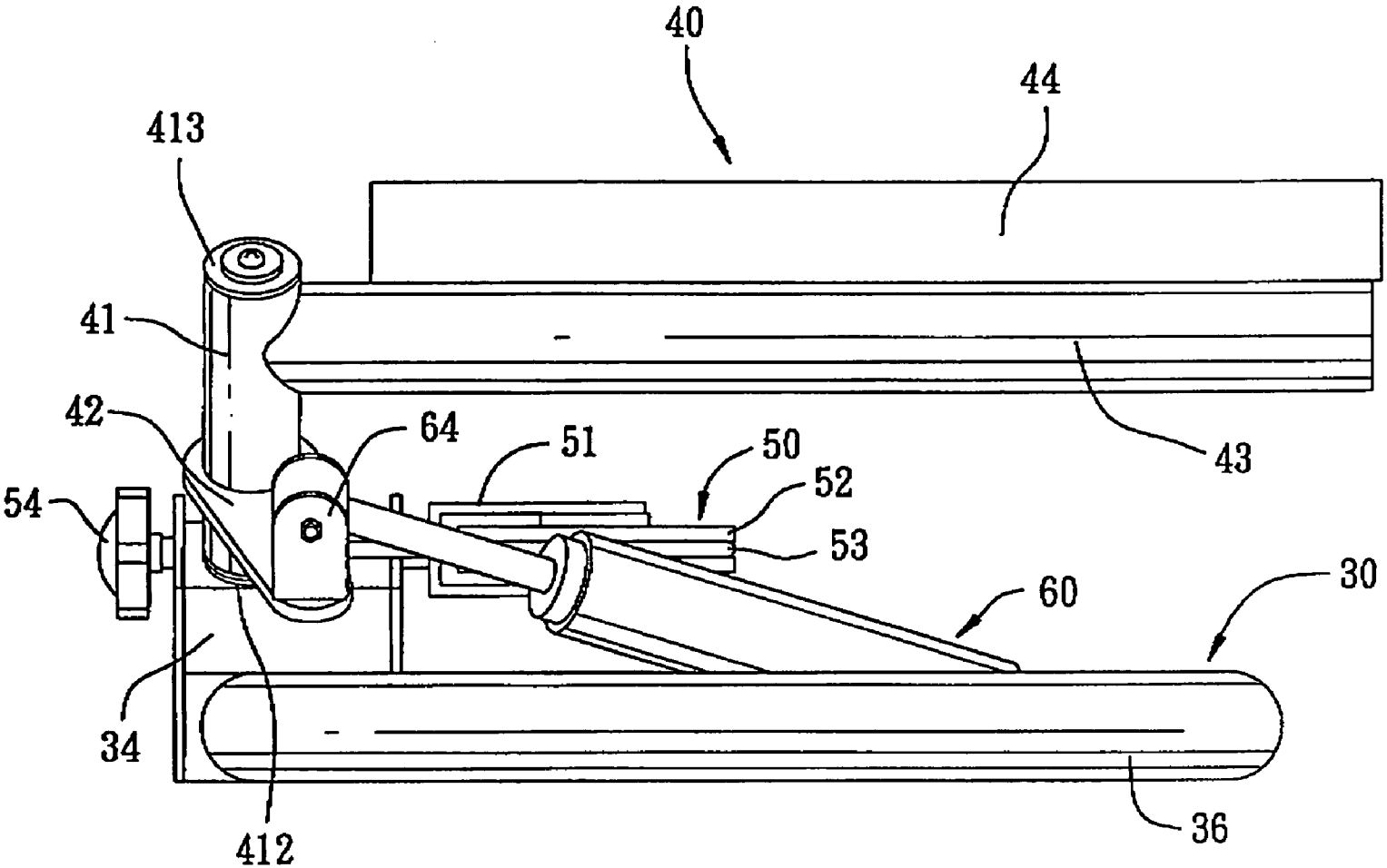
FIG. 6 is a schematic side view showing the preferred embodiment.
Figure 7:
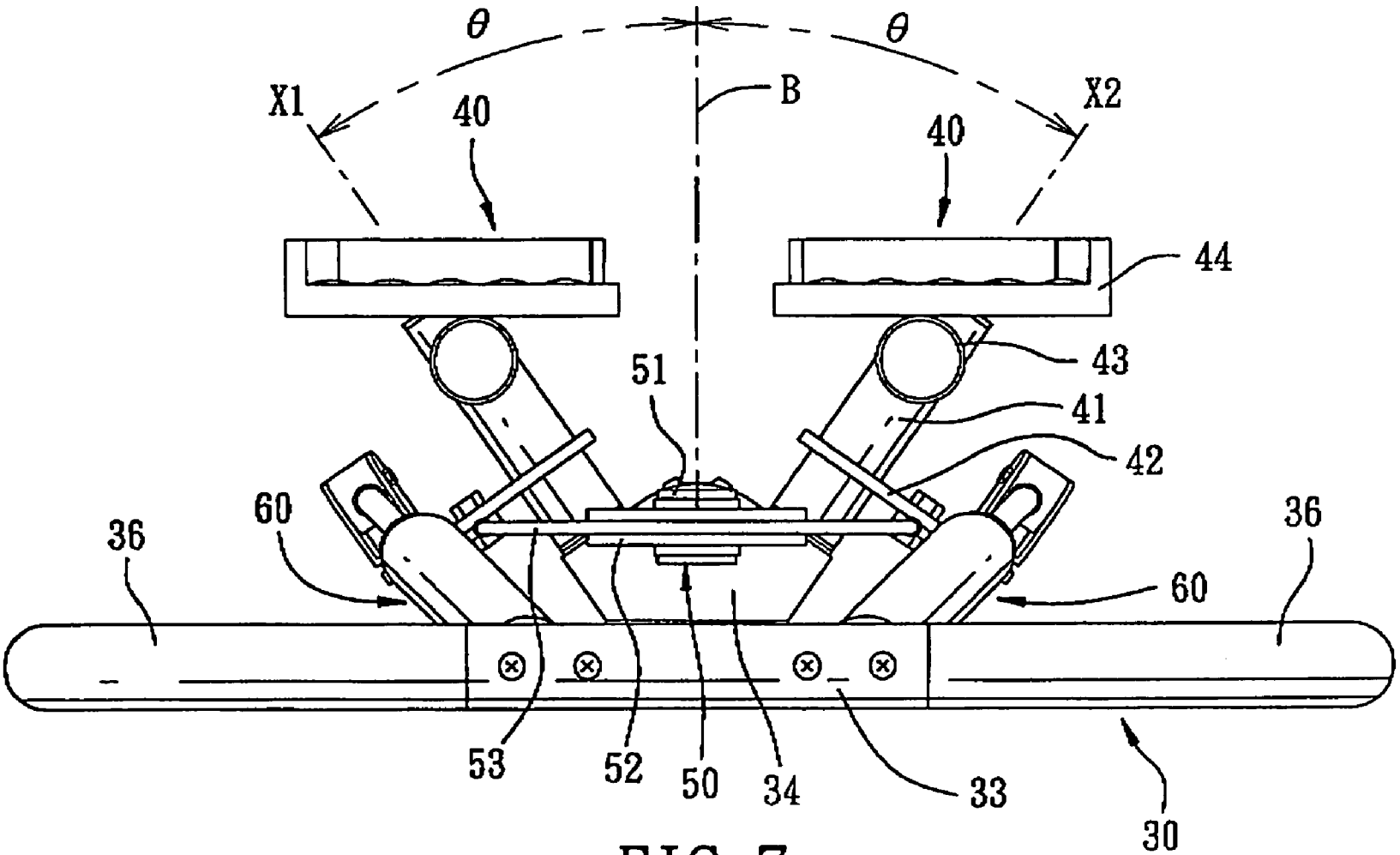
FIG. 7 is a schematic rear side view showing the preferred embodiment.

Each of the stepper members 40 includes a pivot tube 41 sleeved rotatably on a respective one of the pivot poles 35, a supporting rod 43 extending from the pivot tube 41 in the longitudinal direction (A) toward the rear end portion 33 of the base frame 30, a foot support 44 mounted on the supporting rod 43, and a coupling flange 42 extending from the pivot tube 41 away from the vertical plane (B) and formed with two fastener holes 421, 422, as best shown in FIGS. 4 and 7. In this embodiment, each of the stepper members 40 further includes a washer set 412 sleeved rotatably on the respective one of the pivot poles 35 and mounted on a lower open end 414 of the pivot tube 41, and a cap set 413 mounted on an upper open end 411 of the pivot tube 41, as best shown in FIGS. 4 and 6.

Figure 8:
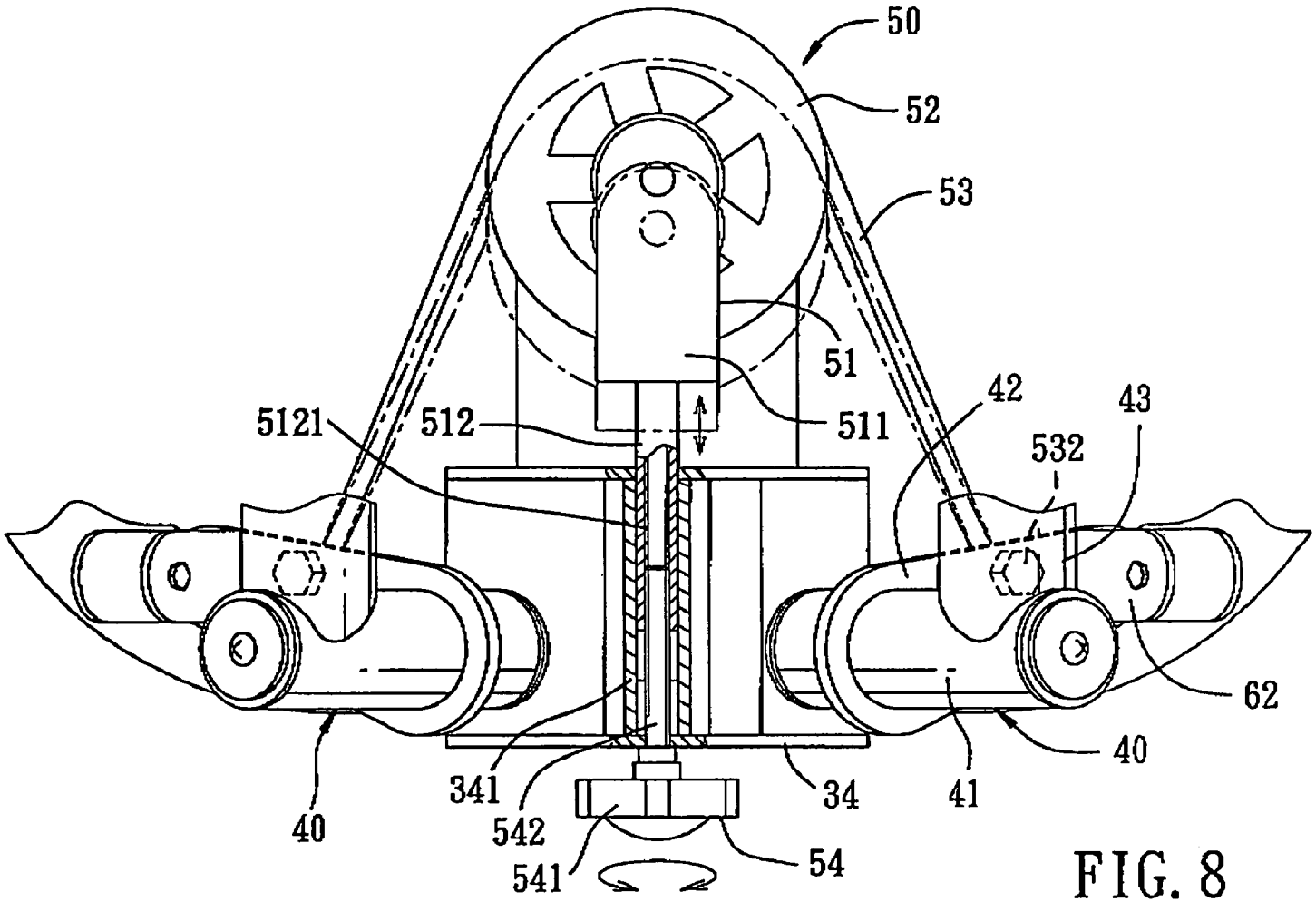
FIG. 8 is a fragmentary, partly sectional, schematic top view showing a coupling unit of the preferred embodiment.

The coupling unit 50 includes a reel-mounting seat 51 mounted on and movable in the longitudinal direction (A) relative to the front end portion 32 of the base frame 30, a reel 52 mounted rotatably on the reel-mounting seat 51 and disposed between the stepper members 40, and a cord 53 wound on the reel 52 and having opposite ends 531, each of which is connected to the coupling flange 42 of a respective one of the stepper members 40 by means of a screw fastener 532 that extends through the fastener hole 421. It is noted that the coupling unit 50 further includes a threaded fastening device 54 to fasten movably the reel-mounting seat 51 to the front end portion 32 of the base frame 30. In this embodiment, as shown in FIG. 8, the reel-mounting seat 51 has an axial tube portion 512 extending into a mounting hole 341 in the pole-mounting seat 34 and formed with a threaded hole 5121, and a U-shaped seat portion 511 connected to the axial tube portion 512. The reel 52 is mounted rotatably on the seat portion 511. The threaded fastening device 54 includes a threaded rod 542 extending into the mounting hole 341 in the pole-mounting seat 34 and engaging the threaded hole 5121 in the axial tube portion 512 of the reel-mounting seat 51 of the coupling unit 50, and an operating head 541 connected to the threaded rod 542 and disposed outwardly of the pole-mounting seat 34. In view of the above configuration, the tension of the cord 53 can be adjusted as a result of operation of the operating head 541 of the threaded fastening device 54 for moving the U-shaped seat portion 511 in the longitudinal direction (A) toward and away from the front end portion 32 of the base frame 30.

In this embodiment, each of the damping members 60 is a length-variable fluid cylinder, and has a cylinder end portion 61 pivoted to a pivot seat 63, which is mounted on the intermediate portion 31 adjacent to the rear end portion 33 of the base frame 30, and a rod end portion 62 pivoted to a U-shaped pivot seat 64, which is mounted on the coupling flange 42 of a respective one of the stepper members 40 at the fastener hole 422.

Figure 9:
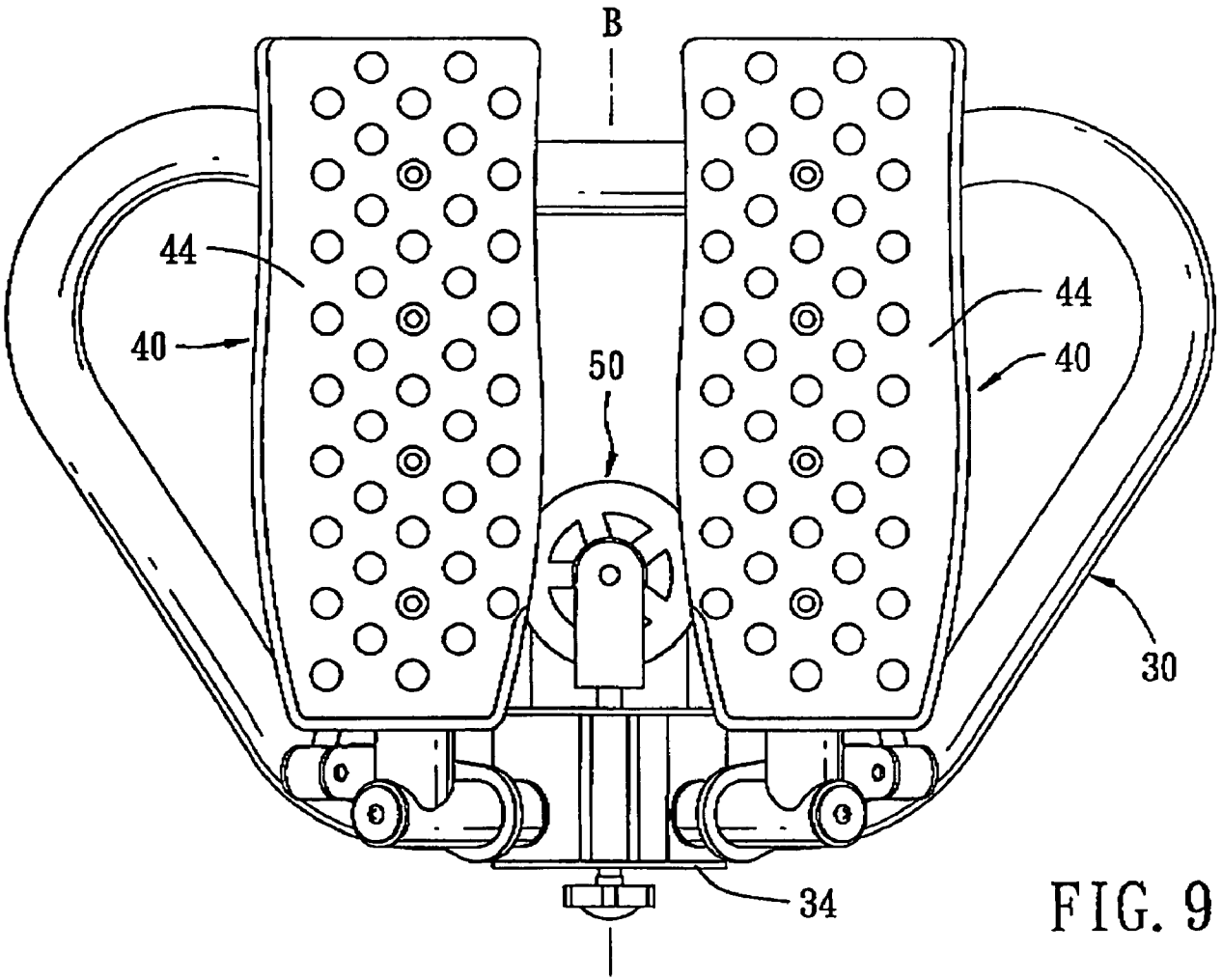
FIG. 9 is a schematic top view showing the preferred embodiment.
Figure 10:
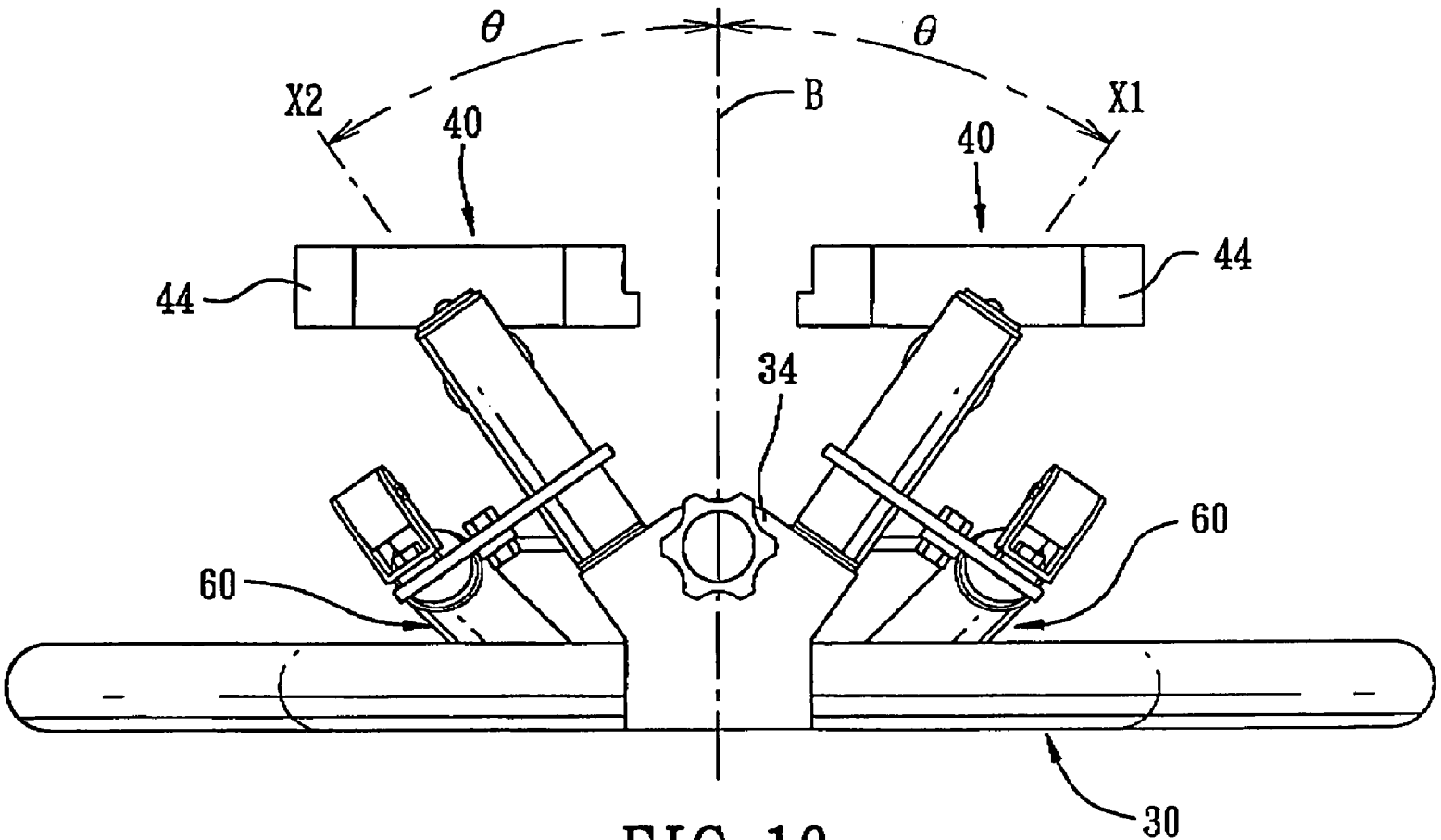
FIG. 10 is a schematic front view showing the preferred embodiment.
Figure 11:
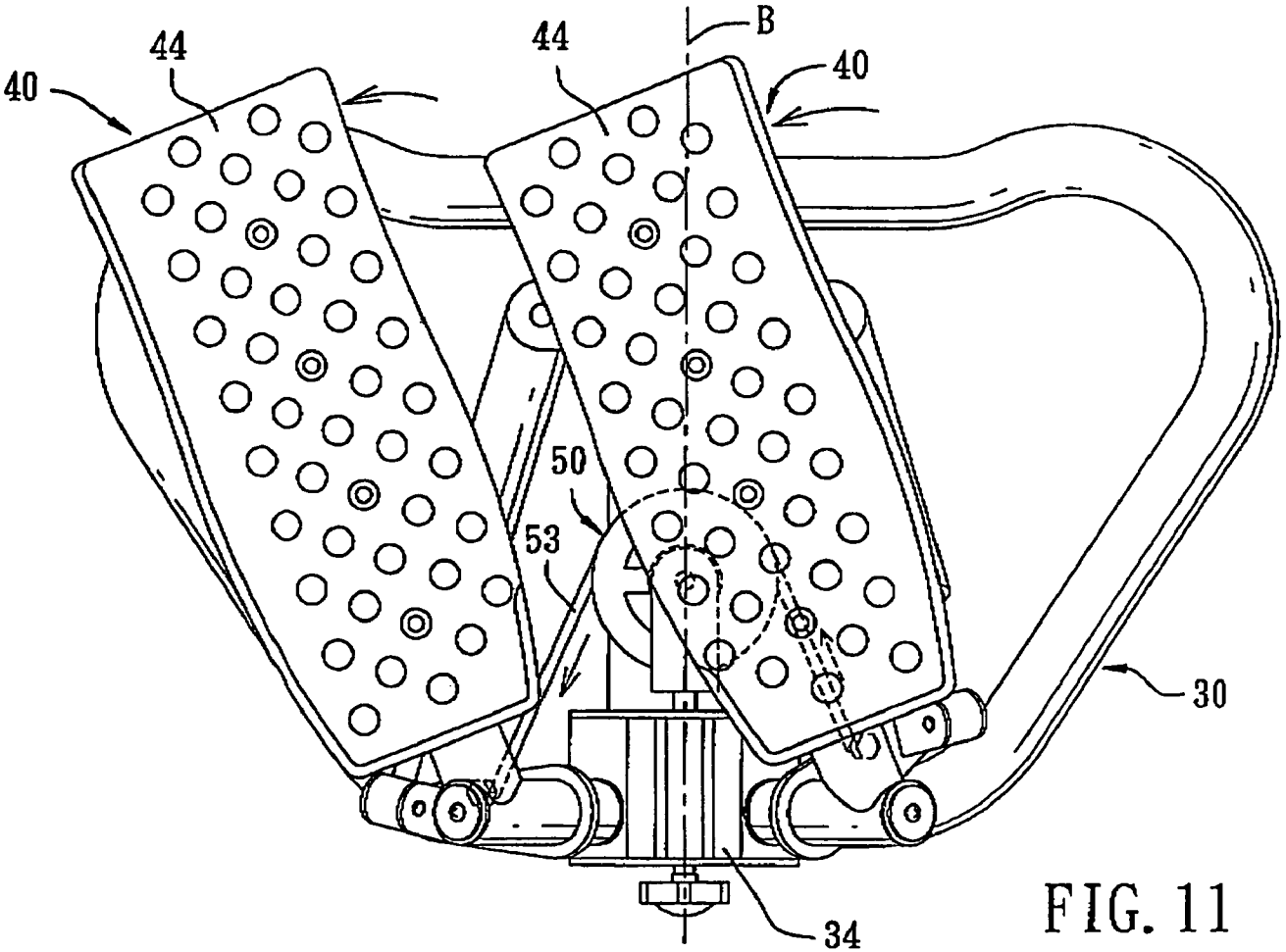
FIG. 11 is a schematic top view showing the preferred embodiment in a state of use.
Figure 12:
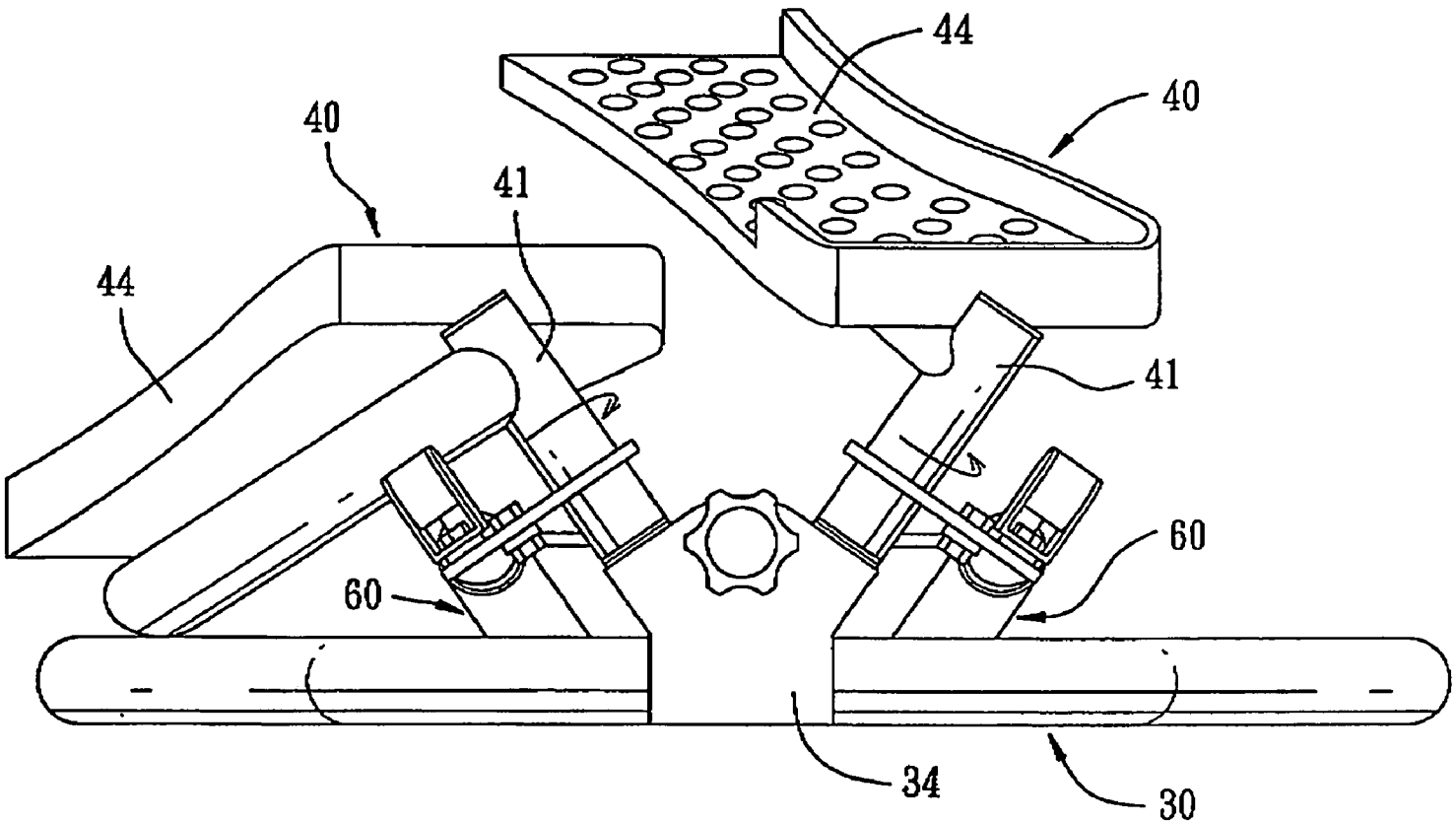
FIG. 12 is a schematic front view showing the preferred embodiment of FIG. 11.

In actual use, due to the presence of the coupling unit 50, each of the stepper members 40 is pivotable about the respective pivot pole 35 so as to drive the foot support 44 of one of the stepper members 40 to move from an initial horizontal position, where the foot support 44 of said one of the stepper members 40 is disposed parallel to and is flush with the foot support 44 of the other one of the stepper members 40, as shown in FIGS. 9 and 10, to a first position, where the foot support 44 of said one of the stepper members 40 is downwardly and rearwardly inclined and is moved away from the vertical plane (B), or a second position, where the foot support 44 of said one of the stepper members 40 is upwardly and rearwardly inclined and is moved toward the vertical plane (B), and at the same time, drive the foot support 44 of the other one of the stepper members 40 to move from the initial horizontal position to the second position or the first position, as shown in FIGS. 11 and 12, such that skiing exercise can be achieved.

Moreover, due to the presence of the two damping members 60 and the coupling unit 50, the skiing exercise device of the present invention has a relatively simple construction as compared to the aforesaid conventional skiing exercise device such that the skiing exercise device of the present invention is less expensive to fabricate.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A skiing exercise device comprising:

a base frame having front and rear end portions opposite to each other in a longitudinal direction, said front end portion having a pair of pivot poles disposed on opposite sides of a vertical plane that is parallel to the longitudinal direction, each of said pivot poles having an upwardly facing pole axis that inclines at an angle relative to the vertical plane;

a pair of stepper members, each of which includes a pivot tube sleeved rotatably on a respective one of said pivot poles, a supporting rod extending from said pivot tube in the longitudinal direction toward said rear end portion of said base frame, a foot support mounted on said supporting rod, and a coupling flange extending from said pivot tube away from the vertical plane; and a coupling unit including a reel-mounting seat mounted on and movable in the longitudinal direction relative to said front end portion of said base frame, a reel mounted rotatably on said reel-mounting seat and disposed between said stepper members, and a cord wound on said reel and having opposite ends that are connected respectively to said coupling flanges of said stepper members.

2. The skiing exercise device as claimed in claim 1, further comprising a pair of damping members, each of which has a first end portion pivoted to said base frame, and a second end portion opposite to said first end portion and pivoted to said coupling flange of a respective one of said stepper members.

3. The skiing exercise device as claimed in claim 2, wherein each of said damping members is a length-variable fluid cylinder.

4. The skiing exercise device as claimed in claim 1, wherein said coupling unit further includes a threaded fastening device to fasten movably said reel-mounting seat to said front end portion of said base frame.

* * * * *